US007502573B2

(12) United States Patent
Ohata et al.

(10) Patent No.: US 7,502,573 B2
(45) Date of Patent: Mar. 10, 2009

(54) IMAGE FORMING APPARATUS HAVING A HEAT-DISCHARGING ROTARY-TYPE DEVELOPMENT UNIT

(75) Inventors: Atsushi Ohata, Toyokawa (JP); Junichi Tanimoto, Toyokawa (JP); Hiroshi Ibaraki, Okazaki (JP); Shoji Fukui, Aichi-ken (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 260 days.

(21) Appl. No.: 11/374,007

(22) Filed: Mar. 14, 2006

(65) Prior Publication Data

US 2007/0116488 A1 May 24, 2007

(30) Foreign Application Priority Data

Nov. 21, 2005 (JP) ..... 2005-335136

(51) Int. Cl.
*G03G 21/20* (2006.01)

(52) U.S. Cl. ..... 399/92; 399/227

(58) Field of Classification Search ..... 399/91–93, 399/227, 107

See application file for complete search history.

(56) References Cited

U.S. PATENT DOCUMENTS

2003/0235428 A1* 12/2003 Suzuki et al. ..... 399/107
2006/0029408 A1* 2/2006 Suzuki et al. ..... 399/49

FOREIGN PATENT DOCUMENTS

JP 07098540 A * 4/1995
JP 2002278211 A * 9/2002
JP 2003-280494 10/2003

* cited by examiner

*Primary Examiner*—David M Gray
*Assistant Examiner*—Erika J. Villaluna
(74) *Attorney, Agent, or Firm*—Morrison & Foerster LLP

(57) ABSTRACT

An image forming apparatus according to the invention includes, in an apparatus body, an image carrier on which an electrostatic latent image is formed; and a rotary-type development unit being rotatable about an axis thereof and having a plurality of developing devices, which are used for developing the latent images formed on the image carrier. The rotary-type development unit is formed with cavities at an outer periphery thereof for receiving gas. The rotary-type development unit is rotated for sequentially advancing the gas in the cavities whereby the gas in the apparatus body is discharged out of the apparatus body.

7 Claims, 8 Drawing Sheets

IMAGE FORMING APPARATUS HAVING A HEAT-DISCHARGING ROTARY-TYPE DEVELOPMENT UNIT

RELATED APPLICATION

This application is based on application No. 335136/2005 filed in Japan, the contents of which are hereby incorporated by reference.

BACKGROUND OF THE INVENTION

1. Field of the Invention

The present invention relates to an image forming apparatus such as electrophotographic copiers and printers. Particularly, the invention relates to an image forming apparatus including in its apparatus body: an image carrier on which an electrostatic latent image is formed; and a rotary-type development unit being rotatable about an axis thereof and having a plurality of developing devices, which are used for developing the latent images formed on the image carrier.

2. Description of the Related Art

The image forming apparatus, such as the copiers and printers, generally forms images as follows. As shown in FIG. 1, an image carrier 1 shaped like a drum and disposed in an apparatus body 10 is rotated, while a surface of the image carrier 1 is charged by means of a charger unit 2. Subsequently, the image carrier 1 thus charged is exposed to light from an exposure unit 3 according to an image signal, whereby an electrostatic latent image is formed on the surface of the image carrier 1.

Next, a development unit 4 supplies a toner to the surface of the image carrier 1 with the electrostatic latent image formed thereon, thereby forming a toner image on the surface of the image carrier 1. The toner image is transferred to a recording sheet 6 by means of a transfer unit 5. Then, the recording sheet 6 with the toner image transferred thereto is transported to a fixing unit 7, which fixes the toner image to the recording sheet 6. On the other hand, the toner remaining on the surface of the image carrier 1 after the toner image transfer is removed from the surface of the image carrier 1 by means of a cleaner 8.

In a case where the apparatus carries out the image formation as described above, the apparatus encounters a problem that the exposure unit 3 and the like disposed in the apparatus body 10 generate heat to raise temperatures in the apparatus body 10. There is another problem that ozone is released when the charger unit 2 charges the surface of the image carrier 1 and hence, the ozone is accumulated in the apparatus body 10.

In this connection, the following proposal has been made in the prior art. That is, the aforementioned image forming apparatus is provided with an air exhaust such as a fan, which is operated for forcibly discharging the heat, ozone and such generated in the apparatus body out of the apparatus body (see Japanese Unexamined Patent Publication No. 2003-280494).

However, if the image forming apparatus is provided with the air exhaust for forcibly discharging the heat, ozone and such generated in the apparatus body out of the apparatus body, the apparatus suffers disadvantages of increased size and increased running cost.

More recently, an image forming apparatus employing a rotary-type development unit 40 is used as an apparatus for forming full color images, the rotary-type development unit including plural developing devices 4A to 4D containing toners of different colors and retained by a rotatable support body 41, as shown in FIG. 2.

In this image forming apparatus, the rotary-type development unit 40 is rotated by means of the support body 41 so as to shift the developing devices 4A to 4D, in turn, to position opposite the image carrier 1. The developing devices 4A to 4D in turn supply the toners of the individual colors to the image carrier 1. The toners thus supplied to the image carrier 1 are sequentially transferred to an intermediate transfer belt 9, so that a full-colored toner image is formed on the intermediate transfer belt 9.

Subsequently, the full-colored toner image is transferred from the intermediate transfer belt 9 to the recording sheet 6, such as recording paper, by means of the transfer unit 5. The full-colored toner image so transferred is fixed to the recording sheet 6 by means of the fixing unit 7.

Unfortunately, in a case where the image forming apparatus for forming the full color image is provided with the air exhaust for forcibly discharging the heat, ozone and such generated in the apparatus body out of the apparatus body, the apparatus is further increased in size.

SUMMARY OF THE INVENTION

It is an object of the invention to solve the aforementioned problem encountered by the image forming apparatus which includes, in the apparatus body, the image carrier on which the electrostatic latent image is formed, and the rotary-type development unit being rotatable about an axis thereof and having a plurality of developing devices, which are used for developing the latent images formed on the image carrier.

Specifically, the invention deals with the case where the exposure unit and the like disposed in the apparatus body generate heat or the charger unit charging the surface of the image carrier generates ozone during the image formation carried out by the above image forming apparatus, and has the object to permit the image forming apparatus, which is not provided with the additional air exhaust, to discharge the heat, ozone and such generated in the apparatus body out of the apparatus body in an easy manner.

An image forming apparatus according to the invention comprises in an apparatus body: an image carrier on which an electrostatic latent image is formed; and a rotary-type development unit being rotatable about an axis thereof and having a plurality of developing devices, which are used for developing the latent images formed on the image carrier, wherein cavities for receiving gas are formed at an outer periphery of the rotary-type development unit, and wherein the gas in the cavities is sequentially advanced by way of the rotation of the rotary-type development unit whereby the gas in the apparatus body is discharged out of the apparatus body.

In the above image forming apparatus, the cavities at the outer periphery of the rotary-type development unit may be formed by forming a recess at an outer periphery of each of the developing devices of the rotary-type development unit.

In a case where a heat release source exists in the apparatus body of the above image forming apparatus, the gas heated in the apparatus body by the heat from the heat release source may be discharged out of the apparatus body by way of the rotation of the rotary-type development unit.

In the above image forming apparatus wherein the heat release source exists in the apparatus body, it is preferred that a partitioning member is disposed in the apparatus body for defining a region including the rotary-type development unit, and that an introduction portion is disposed for introducing the gas into the region defined to include the rotary-type development unit whereas an exhaust portion for discharging the gas in the above region out of the apparatus body is disposed at place downstream from the introduction portion with respect to a rotational direction of the rotary-type development unit.

In the image forming apparatus wherein the partitioning member is disposed in the apparatus body for defining the region including the rotary-type development unit, it is preferred that a first pivotal member is swung along the outer periphery of the rotary-type development unit and disposed in the exhaust portion, and that the introduction portion is provided with a second pivotal member pivotally swung along the outer periphery of the rotating rotary-type development unit.

In a case where an ozone release source generating ozone exists in the apparatus body of the above image forming apparatus, the gas containing the ozone released from the ozone release source and dwelling in the apparatus body may be discharged out of the apparatus body by way of the rotation of the rotary-type development unit.

In the above image forming apparatus wherein the ozone release source exists in the apparatus body, it is preferred that a partitioning member is disposed in the apparatus body for defining a region including the rotary-type development unit and the ozone release source, and that an outside-air intake portion is disposed for introducing the outside air into the region defined by the partitioning member whereas an exhaust portion for discharging the gas in the region out of the apparatus body is disposed at place downstream from the outside-air intake portion with respect to a rotational direction of the rotary-type development unit.

In the image forming apparatus wherein the partitioning member is disposed in the apparatus body such as to define the region including the rotary-type development unit and the ozone release source, it is preferred that the first pivotal member is swung along the outer periphery of the rotary-type development unit and disposed in the exhaust portion, that a third pivotal member is swung along the outer periphery of the rotary-type development unit and disposed in the outside-air intake portion, and that a guide member for guiding the outside air, introduced through the outside-air intake portion, to the ozone release source is disposed in the region including the rotary-type development unit and the ozone release source.

In the image forming apparatus according to the invention, the cavities for receiving the gas are formed at the outer periphery of the rotary-type development unit being rotatable about an axis thereof and having a plurality of developing devices, as described above, whereas the gas received in the cavities is sequentially advanced by way of the rotation of the rotary-type development unit so that the gas in the apparatus body is discharged out of the apparatus body. Even though the apparatus is not provided with the additional air exhaust, therefore, the apparatus is capable of easily discharging, out of the apparatus body, the gas heated by the heat generated in the apparatus body or the gas containing ozone released from the ozone release source. As a result, the image forming apparatus is not increased in size or running cost.

These and other objects, advantages and features of the invention will become apparent from the following description thereof taken in conjunction with the accompanying drawings which illustrate specific embodiments of the invention.

DESCRIPTION OF THE PREFERRED EMBODIMENTS

Image forming apparatuses according to the embodiments of the invention will be specifically described with reference to the accompanying drawings. It is to be noted that the image forming apparatuses of the invention are not limited to those illustrated by the following embodiments and changes and modifications may be made thereto as required, so long as such changes and modifications do not deviate from the scope of the invention.

First Embodiment

Figure 3:
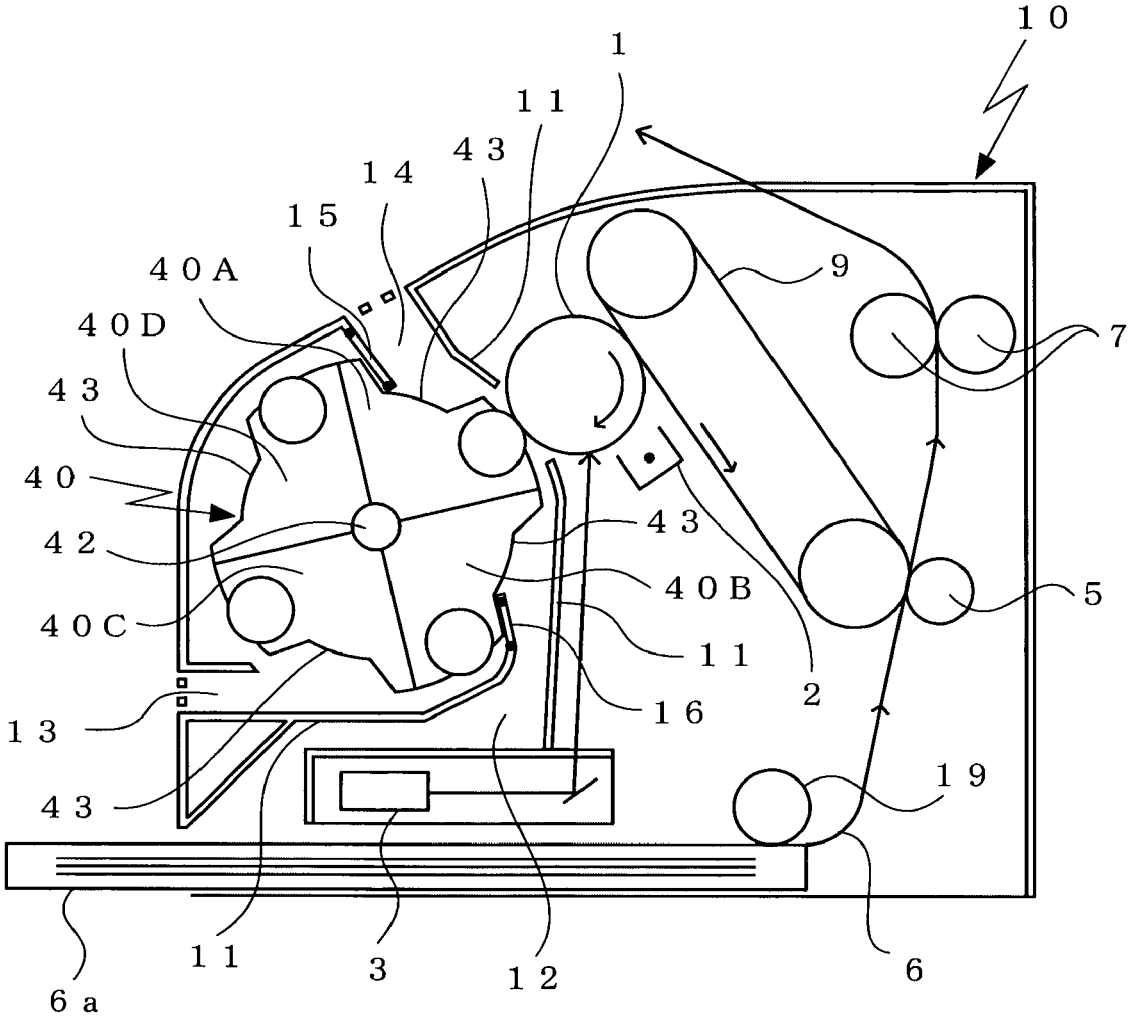
FIG. 3 is a schematic sectional view showing a state where the image formation is carried out by an image forming apparatus according to a first embodiment of the invention.

As shown in FIG. 3, an image forming apparatus according to a first embodiment includes a rotary-type development unit 40 which is disposed in an apparatus body 10 and in which four developing devices 40A to 40D individually containing therein toners of different colors such as yellow, magenta, cyan and black are rotatably retained about a rotary shaft 42 constituting an axis.

Figure 4:
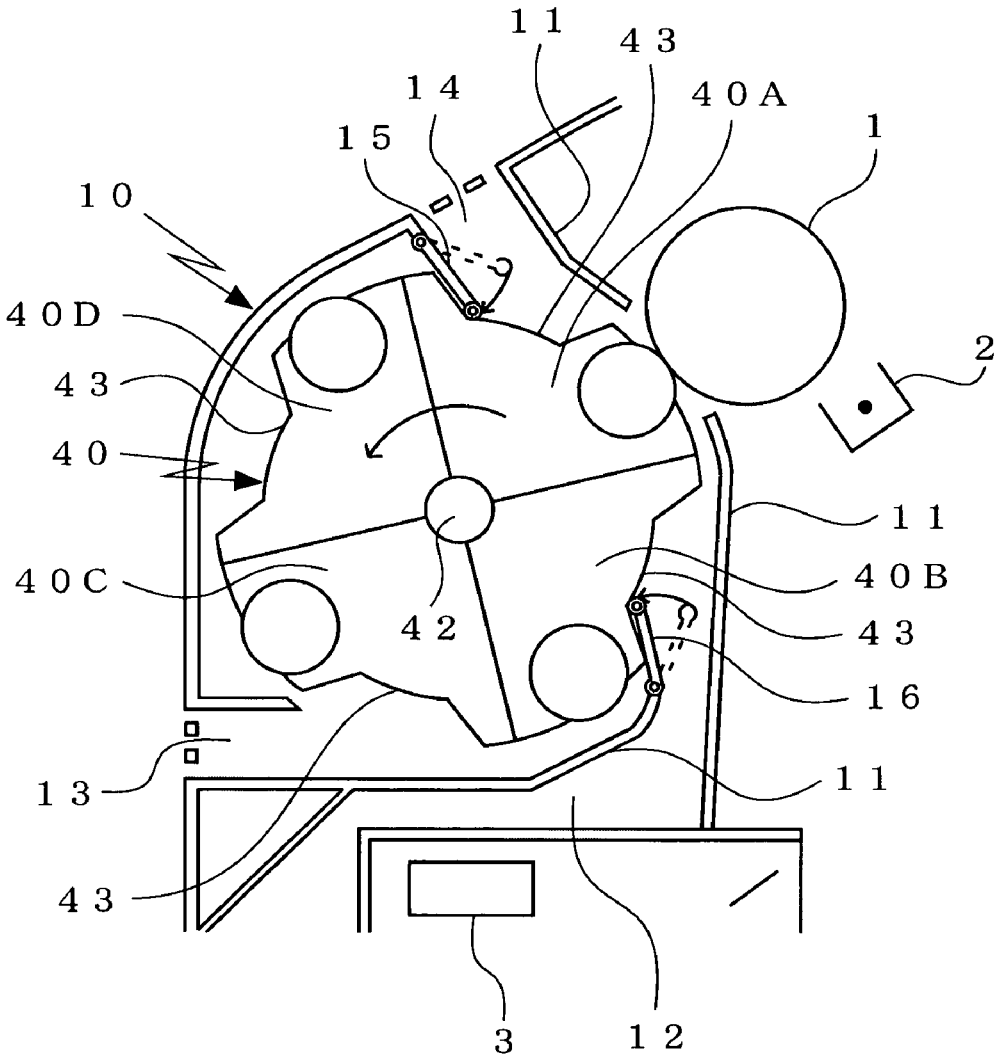
FIG. 4 is a sectional view illustrating a state of the image forming apparatus according to the first embodiment where one developing device of the rotary-type development unit is shifted to position opposite an image carrier.
Figure 5:
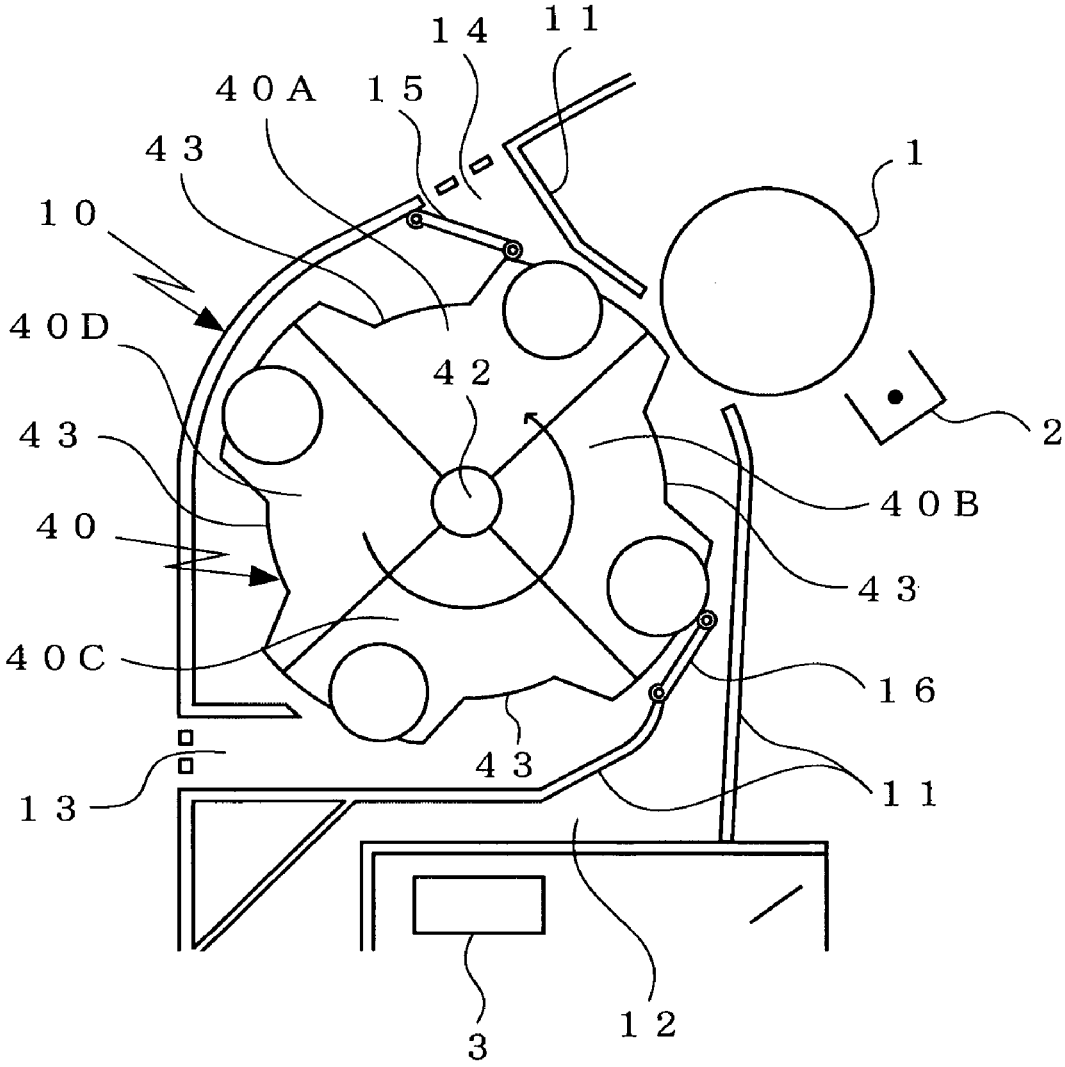
FIG. 5 is a sectional view illustrating a state of the image forming apparatus according to the first embodiment where one developing device of the rotary-type development unit is being shifted to the position opposite the image carrier.

As shown in FIG. 4 and FIG. 5, the rotary-type development unit 40 is rotated about the rotary shaft 42 counterclockwise thereby sequentially shifting the individual developing devices 40A to 40D to position opposite an image carrier 1.

In the image forming apparatus of the first embodiment, each of the developing devices 40A to 40D is formed with a recess 43 at its outer periphery, such that a cavity 43 for receiving gas may be formed at an outer periphery of the rotary-type development unit 40.

In the above image forming apparatus, a partitioning member 11 is disposed in the apparatus body 10 for defining a region including the rotary-type development unit 40. In addition, an introduction portion 12 is disposed for introducing the gas in the apparatus body 10 into the region defined to include the rotary-type development unit 40, whereas an outside-air intake portion 13 is disposed in the vicinity of the introduction portion 12 such as to introduce the air outside the apparatus body 10 into the above region. Furthermore, an exhaust portion 14 for discharging the gas in the above region out of the apparatus body 10 is disposed at place downstream from the introduction portion 12 with respect to a rotational direction of the rotary-type development unit 40.

The above image forming apparatus further comprises a first pivotal member 15 being swung along the outer periphery of the rotary-type development unit 40 and being disposed in the exhaust portion 14. The first pivotal member 15 is adapted for pivotal motion following the contour of the outer periphery or particularly of the recesses 43 of the rotary-type development unit 40.

According to this embodiment, the first pivotal member 15 has its axis of rotation located on a wall surface opposite the partitioning member 11 (the wall surface on the opposite side from the partitioning member via the exhaust portion 14). The first pivotal member 15 presents its distal end against the outer periphery of the rotary-type development unit 40. Hence, the first pivotal member 15 is pivotally moved in conjunction with the rotation of the rotary-type development unit 40, so that a space in the exhaust portion 14, which is defined between the first pivotal member 15 and the partitioning member 11, is varied in volume.

An exposure unit 3 is disposed below the introduction portion 12, whereas a second pivotal portion 16 pivotally swung along the outer periphery of the rotary-type development unit 40 is provided at the introduction portion 12. The second pivotal member 16 is also adapted for pivotal motion following the contour of the outer periphery or particularly of the recesses 43 of the rotary-type development unit 40.

According to this embodiment, the second pivotal member 16 has its axis of rotation located on the partitioning member 11 at place in the introduction portion 12. The second pivotal member 16 presents its distal end against the outer periphery of the rotary-type development unit 40. Hence, the second pivotal member 16 is pivotally moved in conjunction with the rotation of the rotary-type development unit 40, so that a space in the introduction portion 12, which is defined between the second pivotal member 16 and the partitioning member 11, is varied in volume. Negative pressure is produced by varying the volume of the space defined between the second pivotal member 16 and the partitioning member 11 in this manner, enabling efficient introduction of the gas.

Next, description is made on full-color image formation carried out by the image forming apparatus.

First, the rotary-type development unit 40 is operated to position a first developing device 40A containing therein a toner of a predetermined color at place opposite the image carrier 1. The image carrier 1 is rotated for charging a surface thereof by means of a charger unit 2. The image carrier 1 thus charged is exposed to light from the exposure unit 3 according to an image signal, whereby an electrostatic latent image is formed on the surface of the image carrier 1.

In a development region where the image carrier 1 thus formed with the electrostatic latent image thereon opposes the first developing device 40A, the first developing device 40A supplies a yellow toner to an area of the electrostatic latent image formed on the image carrier 1, so as to form a yellow toner image on the image carrier in correspondence to the electrostatic latent image. The yellow toner image so formed on the image carrier 1 is transferred to an intermediate transfer belt 9 looped at place upwardly of the image carrier 1.

Subsequently, the rotary-type development unit 40 is rotated about the rotary shaft 42 for positioning a second developing device 40B containing a magenta toner at place opposite the image carrier 1. The same procedure as that of the first developing device 40A is taken to form a magenta toner image on the surface of the image carrier 1. The magenta toner image is transferred to the intermediate transfer belt 9 with the yellow toner image transferred thereto.

Then, a third developing device 40C containing therein a cyan toner performs the same operation to form a cyan toner image on the surface of the image carrier 1. The cyan toner image is transferred to the intermediate transfer belt 9. Thereafter, a fourth developing device 40D containing therein a black toner forms a black toner image on the surface of the image carrier 1. The black toner image is transferred to the intermediate transfer belt 9. Thus, the yellow, magenta, cyan and black toner images are transferred to the intermediate transfer belt 9 so as to form thereon a full-colored toner image.

Subsequently, a feed roller 19 is operated to deliver a recording sheet 6 from a sheet cassette 6*a* disposed at a lower part of the image forming apparatus to place where the intermediate transfer belt 9 opposes a transfer unit 5. The full-colored toner image formed on the intermediate transfer belt 9 is transferred to the recording sheet 6. The full-colored toner image so transferred onto the recording sheet 6 is fixed thereto by means of a fixing unit 7 and then, the recording sheet is discharged.

In the image forming apparatus of the first embodiment wherein the rotary-type development unit 40 is rotated about the rotary shaft 42 for shifting the four developing devices 40A to 40D in turn to place opposite the image carrier 1, as described above, when the electrostatic latent image formed on the image carrier 1 is developed by one of the four developing devices 40A to 40D, the end of the first pivotal member 15 disposed at the exhaust portion 14 is in contact with the recess 43 formed at the outer periphery of the first developing device 40A of the rotary-type development unit 40, as shown in FIG. 4 for example. Hence, the space in the exhaust portion 14 becomes wider. At the introduction portion 12, on the other hand, the end of the second pivotal member 16 disposed at the introduction portion 12 is in contact with the recess 43 formed at the outer periphery of the second developing device 40B of the rotary-type development unit 40, so that the space in the introduction portion 12 is increased. Then, the gas heated by the exposure unit 3 is introduced into the widened space in the introduction portion 12, through which the heated gas is introduced into the recess 43 formed at the outer periphery of the second developing device 40B.

Then, in the course of shifting the second developing device 40B to place opposite the image carrier 1 by rotating the rotary-type development unit 40 about the rotary shaft 42, as described above, the end of the first pivotal member 15 disposed at the exhaust portion 14 is swung along the outer periphery of the first developing device 40A, or from the recess 43 thereof to a projected outer peripheral portion thereof, as shown in FIG. 5. This brings the first pivotal member 15 into pivotal motion, so that the increased space in the exhaust portion 14 is decreased. As a result, the gas dwelling in the space of the exhaust portion 14 is discharged from the exhaust portion 14 to the outside of the apparatus body 10. In a case where the gas dwelling at the exhaust portion is the heated gas, the heated gas is discharged out of the apparatus body 10. At the introduction portion 12, on the other hand, the end of the second pivotal member 16 disposed at the introduction portion 12 is swung along the outer periphery of the second developing device 40B or from the recess 43 thereof to a projected outer peripheral portion thereof. This brings the second pivotal member 16 into pivotal motion, so that the increased space in the introduction portion 12 is decreased. In the meantime, the heated gas introduced into the recess 43 of the second developing device 40B is advanced toward the exhaust portion 14.

Subsequently when the rotary-type development unit 40 is further rotated to shift the second developing device 40B to place opposite the image carrier 1, the end of the first pivotal member 15 disposed at the exhaust portion 14 is in contact with the recess 43 formed at the outer periphery of the second developing device 40B so that the space in the exhaust portion is increased, just as in the case shown in FIG. 4. Then, the heated gas received in the recess 43 of the second developing device 40B is introduced into the exhaust portion 14 thus widened. On the other hand, the end of the second pivotal member 16 disposed at the introduction portion 12 is in contact with the recess 43 formed at the outer periphery of the third developing device 40C, so that the narrowed space in the introduction portion 12 is increased. As a result, the heated gas dwelling in the introduction portion 12 is sucked into the recess 43 formed at the outer periphery of the third developing device 40C.

At each rotation of the rotary-type development unit 40, the heated gas dwelling in the introduction portion 12 is introduced into the individual recesses 43 of the developing devices 40A to 40B, in turn, in the aforementioned manner. Furthermore, the heated gas so introduced into the individual recesses 43 of the developing devices 40A to 40B is sequentially introduced into the exhaust portion 14 and discharged out of the apparatus body 10. As a result, the heated gas in the apparatus body 10 may be properly discharged out of the apparatus body 10 even though an additional air exhaust, as employed by the conventional apparatus, is not provided.

While the image forming apparatus of the first embodiment is adapted to discharge the gas heated by the exposure unit 3 out of the apparatus body 10 by way of the rotation of the rotary-type development unit 40, the apparatus may also be arranged to discharge the gas heated by the fixing unit 7 out of the apparatus body 10.

Second Embodiment

Figure 6:
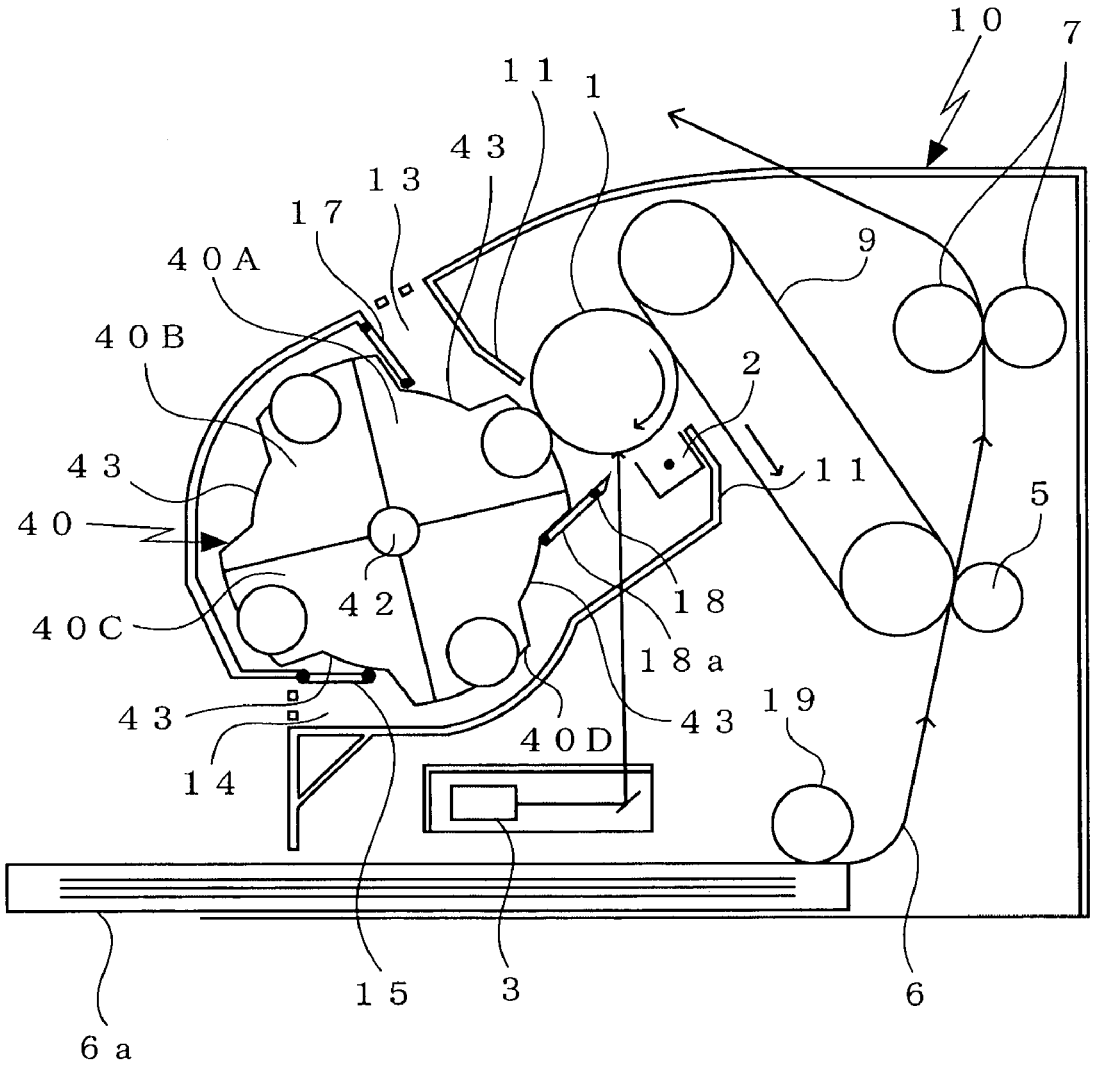
FIG. 6 is a schematic sectional view showing a state where the image formation is carried out by an image forming apparatus according to a second embodiment of the invention.

Similarly to the aforementioned apparatus of the first embodiment, an image forming apparatus according to a second embodiment is also provided with the rotary-type development unit 40 in the apparatus body 10, as shown in FIG. 6. The rotary-type development unit is arranged such that the four developing devices 40A to 40D individually containing therein toners of different colors such as yellow, magenta, cyan and black are rotatably retained about the rotary shaft 42 constituting the axis.

Figure 7:
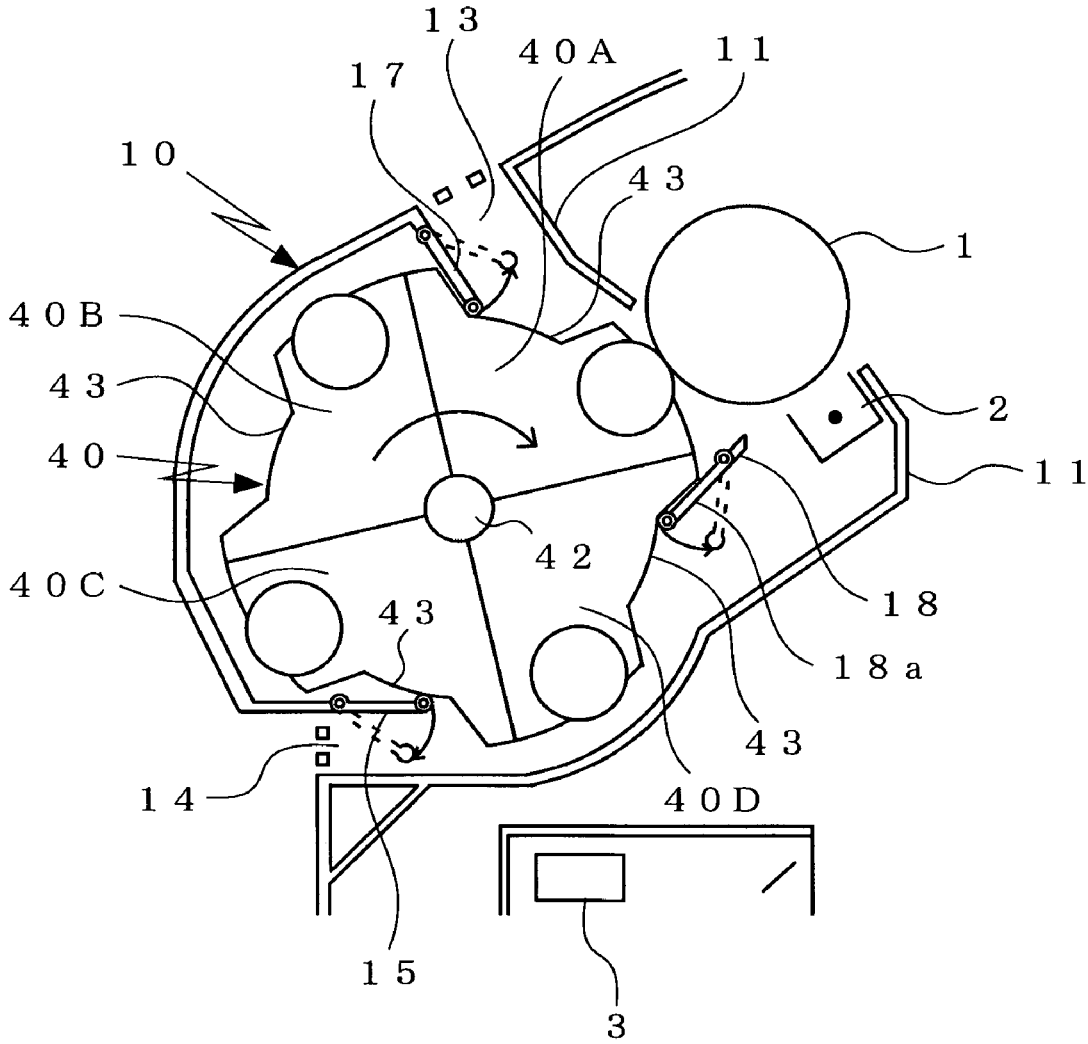
FIG. 7 is a sectional view illustrating a state of the image forming apparatus according to the second embodiment where one developing device of the rotary-type development unit is shifted to the position opposite the image carrier.
Figure 8:
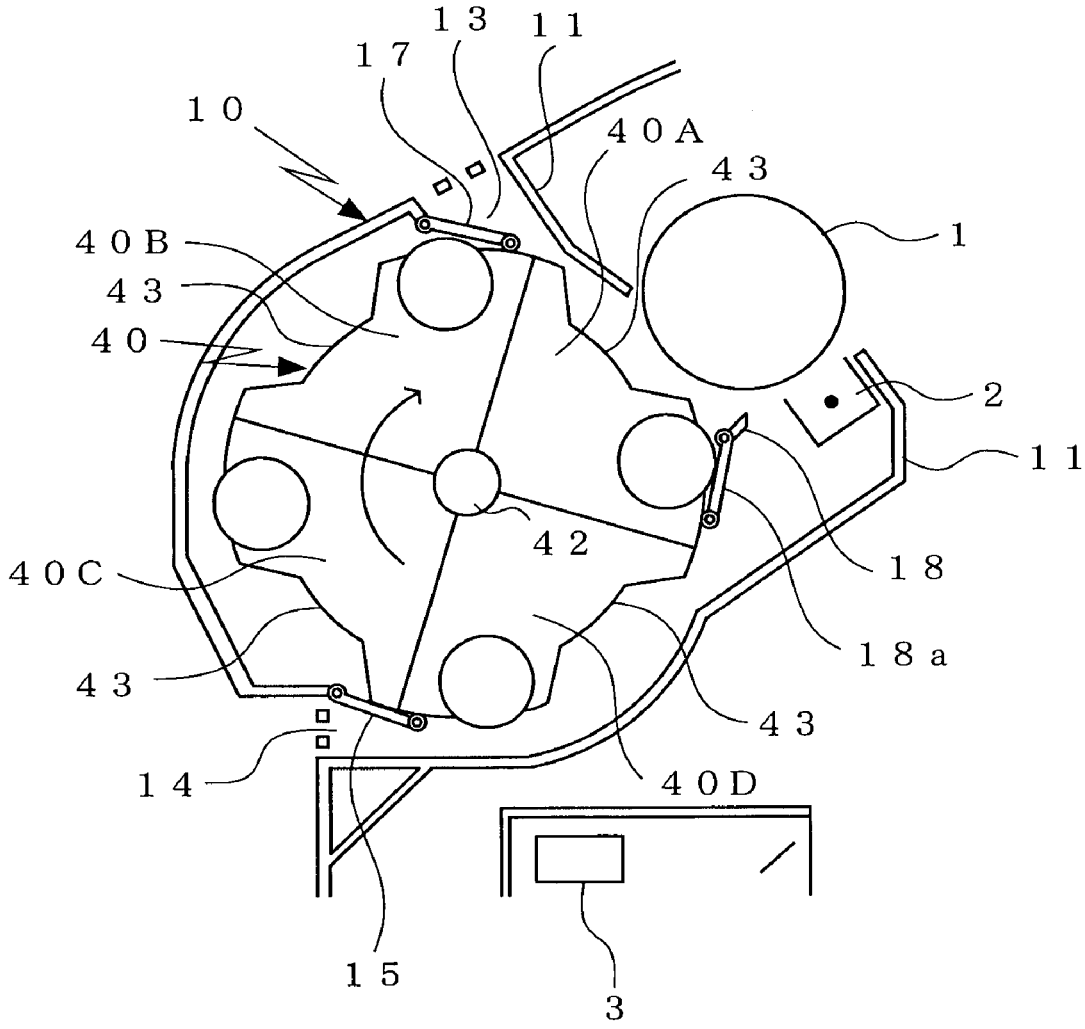
FIG. 8 is a sectional view illustrating a state of the image forming apparatus according to the second embodiment where one developing device of the rotary-type development unit is being shifted to the position opposite the image carrier.

According to the second embodiment, the rotary-type development unit 40 is rotated clockwise about the rotary shaft 42 as shown in FIG. 7 and FIG. 8 or rotated in the opposite direction to that of the first embodiment, thereby shifting the individual developing devices 40A to 40D in turn to position opposite the image carrier 1.

In the image forming apparatus of the second embodiment, as well, each of the developing devices 40A to 40D is formed with the recess 43 at its outer periphery, such that the cavity 43 for receiving the gas may be formed at the outer periphery of the rotary-type development unit 40, just as in the apparatus of the first embodiment.

In the image forming apparatus of the second embodiment, the partitioning member 11 is disposed in the apparatus body 10 such as to define a region including the above rotary-type development unit 40 and the transfer unit 2 constituting an ozone release source. The outside-air intake portion 13 is disposed for introducing the outside air into the region including the rotary-type development unit 40 and the charger unit 2, whereas the exhaust portion 14 for discharging the gas in the above region out of the apparatus body 10 is disposed at place downstream from the outside-air intake portion 13 with respect to the rotational direction of the rotary-type development unit 40.

The image forming apparatus of the second embodiment is also provided with the first pivotal member 15 at the exhaust portion 14, just as in the apparatus of the first embodiment. The first pivotal member 15 presents its distal end against the outer periphery of the rotary-type development unit 40. Hence, the first pivotal member 15 is pivotally moved in conjunction with the rotation of the rotary-type development unit 40, so that the space in the exhaust portion 14 is varied in volume.

The image forming apparatus of the second embodiment further includes a third pivotal member 17 at the outside-air intake portion 13, the pivotal member pivotally swung along the outer periphery of the rotary-type development unit 40. The third pivotal member 17 is adapted for pivotal motion following the contour of the outer periphery or particularly of the recesses 43 of the rotary-type development unit 40.

According to the second embodiment, the third pivotal member 17 has its axis of rotation located on the wall surface opposite the partitioning member 11 (the wall surface on the opposite side from the partitioning member via the outside-air intake portion 13). The third pivotal member 17 presents its distal end against the outer periphery of the rotary-type development unit 40. Hence, the third pivotal member 17 is pivotally moved in conjunction with the rotation of the rotary-type development unit 40, so that the space in the outside-air intake portion 13, as defined between the third pivotal member 17 and the partitioning member 11, is varied in volume. Negative pressure is produced by varying the volume of the space defined between the third pivotal member 17 and the partitioning member 11 in this manner, enabling efficient introduction of the outside air.

The image forming apparatus of this embodiment further includes a guide member 18 interposed between the outside-air intake portion 13 and the exhaust portion 14 for guiding the outside air, introduced through the outside-air intake portion 13, to the charger unit 2. A pivotal member 18*a* at the guide member 18 presents its end against the outer periphery of the rotary-type development unit 40, so that the pivotal member 18*a* at the guide member 18 is pivotally moved in conjunction with the rotation of the rotary-type development unit 40.

Next, description will be made on full-color image formation carried out by this image forming apparatus.

When forming a full color image, the image forming apparatus operates the same way as the apparatus of the first embodiment, except that the rotary-type development unit 40 is rotated in the opposite direction. That is, the rotary-type development unit 40 is rotated to position the first developing device 40A at place opposite the image carrier 1, the developing device containing therein a toner of a specific color. The image carrier 1 is rotated for charging the surface thereof by means of the charger unit 2. The image carrier 1 thus charged is exposed to light from the exposure unit 3 according to an image signal. Thus, an electrostatic latent image is formed on the surface of the image carrier 1.

At the development region where the image carrier 1 with the electrostatic latent image thus formed thereon opposes the first developing device 40A, the first developing device 40A supplies the yellow toner to the area of the electrostatic latent image formed on the image carrier 1, thereby forming thereon a yellow toner image corresponding to the electrostatic latent image. The yellow toner image thus formed on the image carrier 1 is transferred to the intermediate transfer belt 9 looped at place upwardly of the image carrier 1.

Subsequently, the rotary-type development unit 40 is rotated about the rotary shaft 42 so as to position the second developing device 40B at place opposite the image carrier 1, the developing device containing therein the magenta toner. The second developing device operates the same way as the first developing device 40A to form a magenta toner image on the surface of the image carrier 1. The magenta toner image is transferred to the intermediate transfer belt 9 with the yellow toner image transferred thereto.

The same operation is performed so that a cyan toner image is formed on the surface of the image carrier 1 by means of the third developing device 40C containing therein the cyan toner. The cyan toner image is transferred to the intermediate transfer belt 9. Then, a black toner image is formed on the surface of the image carrier 1 by means of the fourth developing device 40D containing therein the black toner. The black toner image is transferred to the intermediate transfer belt 9. Thus, a full-colored toner image is formed on the intermediate transfer belt 9 by transferring thereto the yellow, magenta, cyan and black toner images.

Subsequently, the feed roller 19 is operated to deliver a recording sheet 6 from the sheet cassette 6*a* at the lower part of the image forming apparatus to place where the intermediate transfer belt 9 opposes the transfer unit 5. The full-colored toner image formed on the intermediate transfer belt 9 is transferred to the recording sheet 6. The full-colored toner image so transferred onto the recording sheet 6 is fixed thereto by means of the fixing unit 7 and then, the recording sheet is discharged.

In the image forming apparatus of the second embodiment wherein the rotary-type development unit 40 is rotated about the rotary shaft 42 for shifting the four developing devices 40A to 40D in turn to place opposite the image carrier 1, as described above, when the electrostatic latent image formed on the image carrier 1 is developed by one of the four developing devices 40A to 40D, the end of the first pivotal member 15 disposed at the exhaust portion 14 is in contact with the recess 43 formed at the outer periphery of the third developing device 40C, as shown in FIG. 7 for example. Hence, the space in the exhaust portion 14 is increased. At the outside-air intake portion 13, on the other hand, the end of the third pivotal member 17 disposed at the outside-air intake portion 13 is in contact with the recess 43 formed at the outer periphery of the first developing device 40A, so that the space in the outside-air intake portion 13 is increased. Then, the outside air is introduced into the widened space in the outside-air intake portion 13 and then, into the recess 43 formed at the first developing device 40A. Furthermore, the end of the pivotal member 18*a* at the guide member 18 is in contact with the recess 43 formed at the outer periphery of the fourth developing device 40D, so that a flow path defined between the charger unit 2 and the rotary-type development unit 40 becomes wider. Hence, the gas containing ozone and dwelling near the charger unit 2 is introduced into the recess 43 of the forth developing device 40D.

Then, in the course of shifting the second developing device 40B to place opposite the image carrier 1 by rotating the rotary-type development unit 40 about the rotary shaft 42 as described above, the end of the first pivotal member 15 disposed at the exhaust portion 14 is moved from the recess 43 of the third developing device 40C via the projected outer peripheral portion thereof to the outer periphery of the fourth developing device 40D, as shown in FIG. 8. This brings the first pivotal member 15 into pivotal motion, so that the widened space in the exhaust portion 14 is decreased. As a result, the gas dwelling in the space in the exhaust portion 14 is discharged from the exhaust portion 14 to the outside of the apparatus body 10. If this gas contains ozone, the gas containing ozone is discharged out of the apparatus body 10. At the outside-air intake portion 13, on the other hand, the end of the third pivotal member 17 disposed at the outside-air intake portion 13 is moved from the recess 43 of the first developing device 40A via the projected outer peripheral portion thereof to the outer periphery of the second developing device 40B. This brings the third pivotal member 17 into pivotal motion, so that the widened space in the outside-air intake portion 13 is decreased. Furthermore, the end of the pivotal member 18*a* at the guide member 18 is moved from the recess 43 formed at the outer periphery of the fourth developing device 40D via the projected outer peripheral portion thereof to the outer periphery of the first developing device 40A, so that the gas received in the recess 43 of the first developing device 40A is guided by the guide member 18 toward the charger unit 2. In the meantime, the pivotal member 18*a* at the guide member 18 is pivotally moved to narrow the flow path defined between the charger unit 2 and the rotary-type development unit 40. Thus, the gas containing ozone is received in the recess 43 of the fourth developing device 40D.

Subsequently when the rotary-type development unit 40 is further rotated to shift the second developing device 40B to place opposite the image carrier 1, the end of the first pivotal member 15 at the exhaust portion 14 comes into contact with the recess 43 formed at the outer periphery of the fourth developing device 40D so that the space in the exhaust portion is increased, just as in the case shown in FIG. 7. Then, the gas containing ozone and received in the recess 43 of the fourth developing device 40D is introduced into the widened space in the exhaust portion 14. At the outside-air intake portion 13, on the other hand, the end of the third pivotal member 17 at the outside-air intake portion 13 comes into contact with the recess 43 formed at the outer periphery of the second developing device 40B, so that the space in the outside-air intake portion 13 is increased. The outside air is sucked into the outside-air intake portion 13 thus widened and is introduced into the recess 43 formed at the second developing device 40B. Furthermore, the end of the pivotal member 18*a* at the guide member 18 comes into contact with the recess 43 formed at the outer periphery of the first developing device 40A, so that the flow path defined between the charger unit 2 and the rotary-type development unit 40 becomes wider. Hence, the gas containing ozone and dwelling near the charger unit 2 is guided into the recess 43 of the first developing device 40A.

At each rotation of the rotary-type development unit 40 as described above, the outside air is introduced through the outside-air intake portion 13 into the individual recesses of the developing devices 40A to 40D in turn. The gas thus introduced into the individual recesses 43 of the developing devices 40A to 40D is sequentially advanced toward the charger unit 2 via the guide member 18. In the meantime, the gas containing ozone and dwelling near the charger unit 2 is received sequentially in the individual recesses 43 of the developing devices 40A to 40D, so as to be transported to the exhaust portion 14. Thus, the gas containing ozone is discharged out of the apparatus body 10 via the exhaust portion 14. As a result, the gas containing ozone and dwelling in the apparatus body 10 may be properly discharged out of the apparatus body 10 even though the additional air exhaust, as employed by the conventional apparatus, is not provided.

Figure 1:
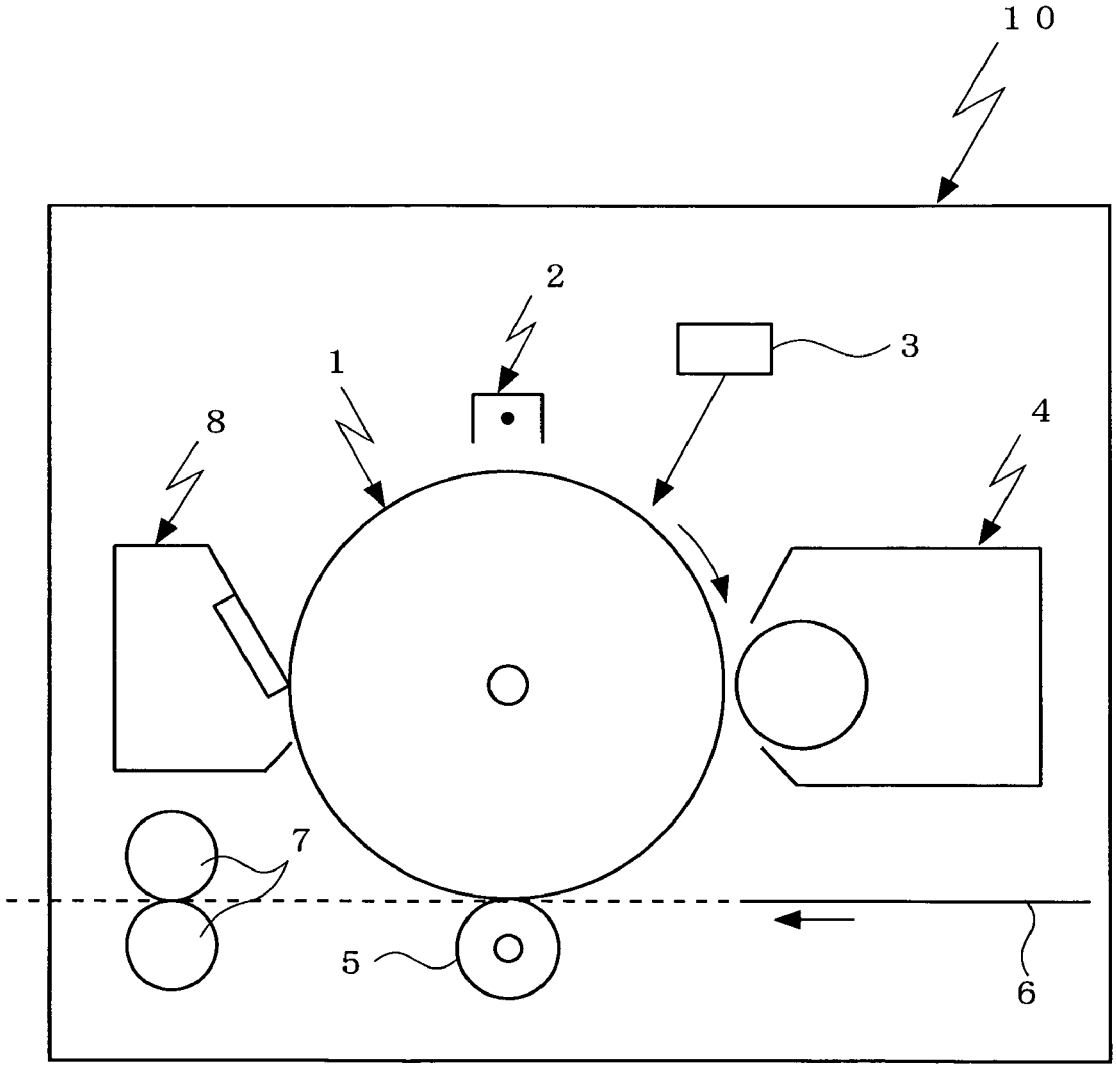
Fig. 1 Prior Art
FIG. 1 is a schematic sectional view showing a state where image formation is carried out by a conventional image forming apparatus.
Figure 2:
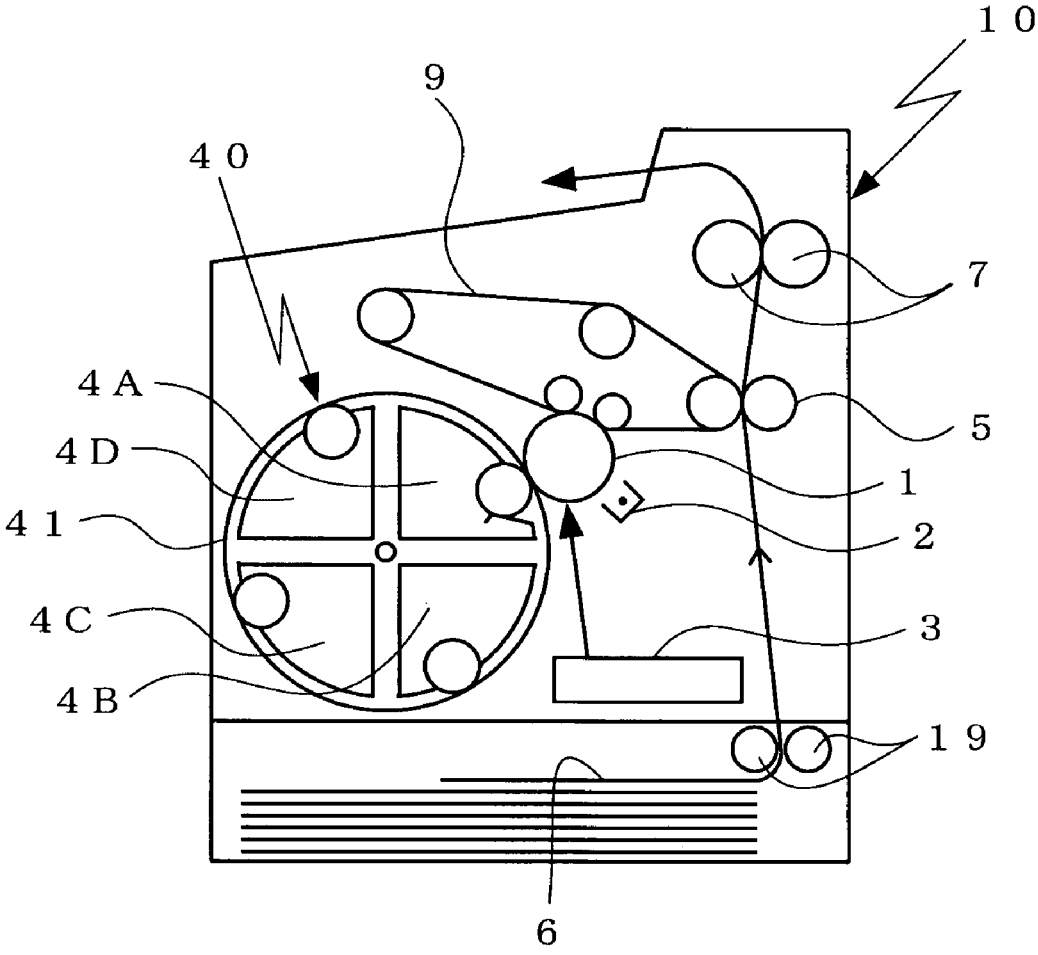
Fig. 2 Prior Art
FIG. 2 is a schematic sectional view showing a state where the image formation is carried out by the conventional image forming apparatus employing a rotary-type development unit including a plurality of developing devices retained by a rotatable support body.

While the image forming apparatuses according the first and second embodiments employ the rotary-type development unit 40 wherein the individual developing devices 40A to 40D are rotatably retained about the rotary shaft 42 constituting the axis, the developing devices 40A to 40D may also be retained by the rotatable support body 41 as illustrated by the conventional image forming apparatus shown in FIG. 2.

In the image forming apparatuses according to the first and second embodiments, the four developing devices 40A to 40D are mounted in the rotary-type development unit 40. However, the number of developing devices to be mounted is not particularly limited and the development unit may also be mounted with a couple of developing devices or with five or more developing devices. While the image forming apparatuses according to the first and second embodiments use the four developing devices of the same configuration, the developing devices need not necessarily have the same configuration.

Although the present invention has been fully described by way of examples, it is to be noted that various changes and modifications will be apparent to those skilled in the art.

Therefore, unless otherwise such changes and modifications depart from the scope of the present invention, they should be construed as being included therein.

The invention claimed is:

1. An image forming apparatus comprising in an apparatus body:

an image carrier on which an electrostatic latent image is formed; and a rotary-type development unit being rotatable about an axis thereof and having a plurality of developing devices, which are used for developing the latent images formed on the image carrier, wherein cavities for receiving gas are formed at an outer periphery of the rotary-type development unit, and wherein the gas in the cavities is sequentially advanced by way of the rotation of the rotary-type development unit whereby gas in the apparatus body is discharged out of the apparatus body, the apparatus body including a heat release source, wherein the gas is heated by heat from the heat release source and later discharged out of the apparatus body by way of the rotation of the rotary-type development unit.

2. An image forming apparatus according to claim 1, wherein the heat release source is an exposure unit for exposing the image carrier to light according to image information.

3. An image forming apparatus according to claim 1, wherein a recess as the cavity is formed at an outer periphery of each of the developing devices.

4. An image forming apparatus according to claim 1, further comprising, a partitioning member being disposed in the apparatus body for defining a region including the rotary-type development unit, an introduction portion being disposed for introducing the gas into the region defined to include the rotary-type development unit, and an exhaust portion for discharging the gas in the region out of the apparatus body being disposed at place downstream from the introduction portion with respect to a rotational direction of the rotary-type development unit.

5. An image forming apparatus according to claim 4, further comprising, a first pivotal member being swung along the outer periphery of the rotary-type development unit and being disposed in the exhaust portion.

6. An image forming apparatus according to claim 4, further comprising, a second pivotal member being swung along the outer periphery of the rotary-type development unit and being disposed in the introduction portion.

7. An image forming apparatus according to claim 4, further comprising, a heat release source being disposed in the vicinity of the introduction portion, wherein the gas heated by the heat from the heat release source is introduced though the introduction portion into the region defined by the partitioning member and including the rotary-type development unit.

* * * * *